US007657217B2

(12) United States Patent
Wakahara et al.

(10) Patent No.: US 7,657,217 B2
(45) Date of Patent: Feb. 2, 2010

(54) IMAGE HEATING APPARATUS AND METHOD FOR MANUFACTURING IMAGE HEATING APPARATUS

(75) Inventors: Shinichiro Wakahara, Tokyo (JP); Koki Watanabe, Moriya (JP); Jiro Shirakata, Kashiwa (JP); Koji Takematsu, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 263 days.

(21) Appl. No.: 11/254,715

(22) Filed: Oct. 21, 2005

(65) Prior Publication Data

US 2006/0089314 A1 Apr. 27, 2006

(30) Foreign Application Priority Data

Oct. 22, 2004 (JP) ..... 2004-308505

(51) Int. Cl.
*G03G 15/20* (2006.01)

(52) U.S. Cl. ..... 399/330; 399/334

(58) Field of Classification Search ..... 399/330, 399/334

See application file for complete search history.

(56) References Cited

U.S. PATENT DOCUMENTS 6,643,491 B2 * 11/2003 Kinouchi et al. ..... 399/330
7,099,616 B2 8/2006 Kato et al. ..... 399/328
2003/0086736 A1 * 5/2003 Sekiguchi et al. ..... 399/328
2004/0206750 A1 10/2004 Sekiguchi et al.
2006/0086725 A1 4/2006 Hosoi et al. ..... 219/619
2006/0086731 A1 4/2006 Shirakata et al. ..... 219/645
2006/0089314 A1 4/2006 Wakahara et al. ..... 514/21
2006/0204292 A1 9/2006 Kato et al. ..... 399/328

FOREIGN PATENT DOCUMENTS

JP 10-74009 3/1998
JP 2004-265670 9/2004
JP 2004-273249 9/2004

* cited by examiner

*Primary Examiner*—David P Porta
*Assistant Examiner*—Bryan P Ready
(74) *Attorney, Agent, or Firm*—Fitzpatrick, Cella, Harper & Scinto

(57) ABSTRACT

An image heating apparatus includes a heating roller for heating an image on a recording material; a coil unit disposed in said heating roller and including a coil for induction heat generation in said heating roller; a supporting member for rotatably supporting said heating roller, wherein said supporting member including a holding portion for substantially non-rotatably holding said coil unit.

6 Claims, 15 Drawing Sheets

IMAGE HEATING APPARATUS AND METHOD FOR MANUFACTURING IMAGE HEATING APPARATUS

FIELD OF THE INVENTION AND RELATED ART

The present invention relates to an image heating apparatus for heating an image on recording medium, and the method for manufacturing such an image heating apparatus.

There is disclosed a fixing apparatus employing one of the heating methods based on electromagnetic induction in Japanese Laid-open Patent Application 10-74009. A typical fixing apparatus of this type comprises a fixation roller and a coil. The fixation roller is heated by the eddy current which is induced in the wall of the fixation roller as the fixation roller is subjected to the magnetic flux generated by the coil. Thus, a fixing apparatus of this type is considered to be advantageous in terms of energy efficiency.

A typical fixing apparatus employing a heating method based on electromagnetic induction (which hereinafter may be referred to simply as inductive fixing apparatus) comprises a fixation roller and a coil, which are physically independent from each other.

The smaller the gap (clearance) between the fixation roller and coil, the higher the energy efficiency. Thus, the positional relationship between the fixation roller and coil is one of the essential factors which affect the energy efficiency of a fixing apparatus.

According to the prior art, however, the position of the fixation roller is set independently from that of the coil, which has been problematic from the perspective of the level of accuracy at which the fixation roller and coil are positioned relative to each other.

With the fixation roller and coil not correctly positioned relative to each other, there is the possibility that if the coil and/or fixation roller deforms due to its own weight and/or the heat of the fixation roller, the coil and fixation will come into contact with each other.

SUMMARY OF THE INVENTION

The primary object of the present invention is to provide an image heating apparatus superior to an image heating apparatus in accordance with any of the prior arts, in terms of the level of accuracy at which the heat roller and coil are positioned relative to each other.

Another object of the present invention is to provide an image heating apparatus superior to an image heating apparatus in accordance with any of the prior arts, in terms of the accuracy of the distance between the heat roller and coil.

According to an aspect of the present invention, there is provided an image heating apparatus comprising a heating roller for heating an image on a recording material; a coil unit disposed in said heating roller and including a coil for induction heat generation in said heating roller; a supporting member for rotatably supporting said heating roller, wherein said supporting member including a holding portion for substantially non-rotatably holding said coil unit.

According to another aspect of the present invention, there is provided a manufacturing method for an image heating apparatus including a heating roller for heating an image on a recording material, and a coil unit including a coil for induction heat generation in said heating roller, said manufacturing method comprising a step of preparing a first supporting member for rotatably supporting the heating roller; a step of preparing a second supporting member for substantially non-rotatably supporting said coil unit; a step of connecting said first supporting member and said second supporting member with each other while said first supporting member and said second supporting member are positioned relative to each other; a step of supporting said heating roller on said first supporting member; and a step of inserting said coil unit from one longitudinal end of said heating roller and supporting said coil unit on said second supporting member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) Example of Image Forming Apparatus

Figure 1:
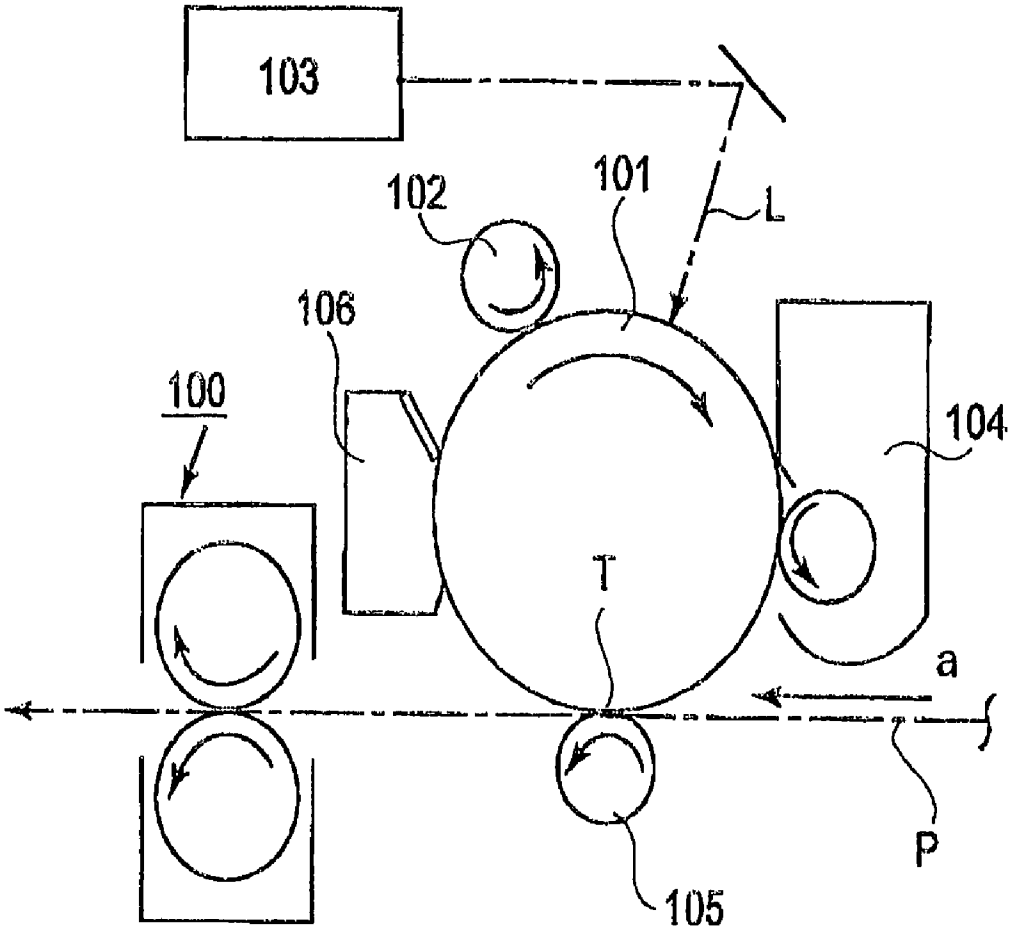
FIG. 1 is a schematic drawing of a typical image forming apparatus.

Hereinafter, the image heating apparatus, as a fixing apparatus, in accordance with the present invention will be described. First, referring to FIG. 1, the image forming apparatus in which this fixing apparatus is disposed will be described before the fixing apparatus is described. The image forming apparatus in this embodiment is a laser beam printer, which uses one of the electrophotographic processes.

Designated by referential symbols 101 is an electrophotographic photosensitive member (which hereinafter will be referred to simply as photosensitive drum), which is rotationally driven in the clockwise direction indicated by an arrow mark, at a preset peripheral velocity.

Designated by a referential symbol 102 is a charge roller, as a charging means, of the contact type, which uniformly charges the peripheral surface of the photosensitive drum 101 to preset polarity and potential level as the photosensitive drum 101 is rotated.

Designated by a referential symbol 103 is a laser scanner as an exposing means, which scans the uniformly charged peripheral surface of the photosensitive drum 101 by emitting a beam of laser light L while modulating it with sequential digital electrical signals which reflect the image formation data, as the photosensitive drum 101 is rotationally driven. As a result, an electrostatic latent image is formed on the peripheral surface of the photosensitive drum 101, in the pattern in which the peripheral surface of the photosensitive drum 101 is scanned by the beam of laser light L.

Designated by a referential symbol 104 is a developing apparatus, which normally or reversely develops the electrostatic latent image on the peripheral surface of the photosensitive drum 101, into an image formed of toner (which hereinafter will be referred to simply as toner image).

Designated by a referential symbol 105 is a transfer roller as a transferring means, which is kept pressed upon the peripheral surface of the photosensitive drum 101 with the application of a preset amount of pressures forming a transfer nip T, to which a recording medium P as an object to be heated is conveyed from an unshown recording medium feeding/conveying mechanism with a preset control timing, and then, is conveyed through the transfer nip T while remaining pinched by the photosensitive drum 101 and transfer roller 105. As the recording medium P is conveyed through the transfer nip T, a preset transfer bias is applied to the transfer roller 105 with a preset control timing. As a result, the toner image on the peripheral surface of the photosensitive drum 101 is electrostatically and gradually transferred onto the surface of the recording medium P.

After being conveyed out of the transfer nip T, the recording medium P is separated from the peripheral surface of the photosensitive drum 101, and introduced into the fixing apparatus 100, which fixes the unfixed toner image on the recording medium P by applying heat and pressure to the introduced recording medium and the unfixed toner image thereon; it turns the unfixed image into a permanent image. After the fixation, the recording medium P is conveyed out of the fixing apparatus.

Designated by a referential symbol 106 is a device for cleaning the photosensitive drum 101, which removes the transfer residual toner, that is, the toner remaining on the peripheral surface of the photosensitive drum 101 after the separation of the recording medium P from the peripheral surface of the photosensitive drum 101. After the cleaning of the peripheral surface of the photosensitive drum 101, that is, the removal of the transfer residual toner, the peripheral surface of the photosensitive drum 101 is used for the following image formation cycle; the peripheral surface of the photosensitive drum 101 is repeatedly used for image formation.

The direction indicated by a referential symbol a is the direction in which the recording medium P is conveyed. As for the positioning of the recording medium P relative to the main assembly of the image forming apparatus, in terms of the direction perpendicular to the recording medium, conveyance direction a, the recording medium P is conveyed through the main assembly so that the centerline of the recording medium P is kept aligned with the center of the fixing apparatus (fixation roller).

(2) Fixing Apparatus 100

Figure 2:
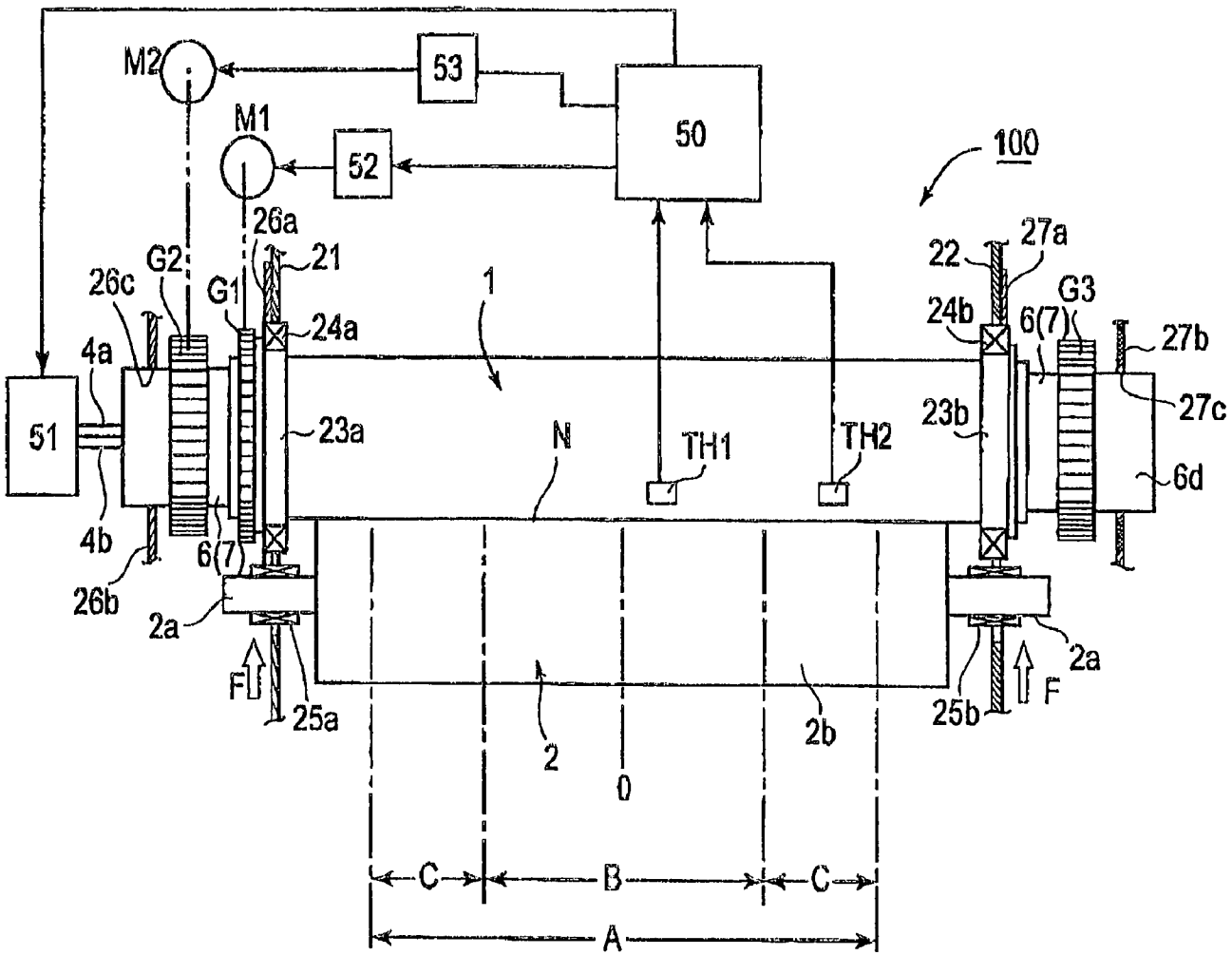
FIG. 2 is a schematic front view of the essential portions of the fixing apparatus.
Figure 3:
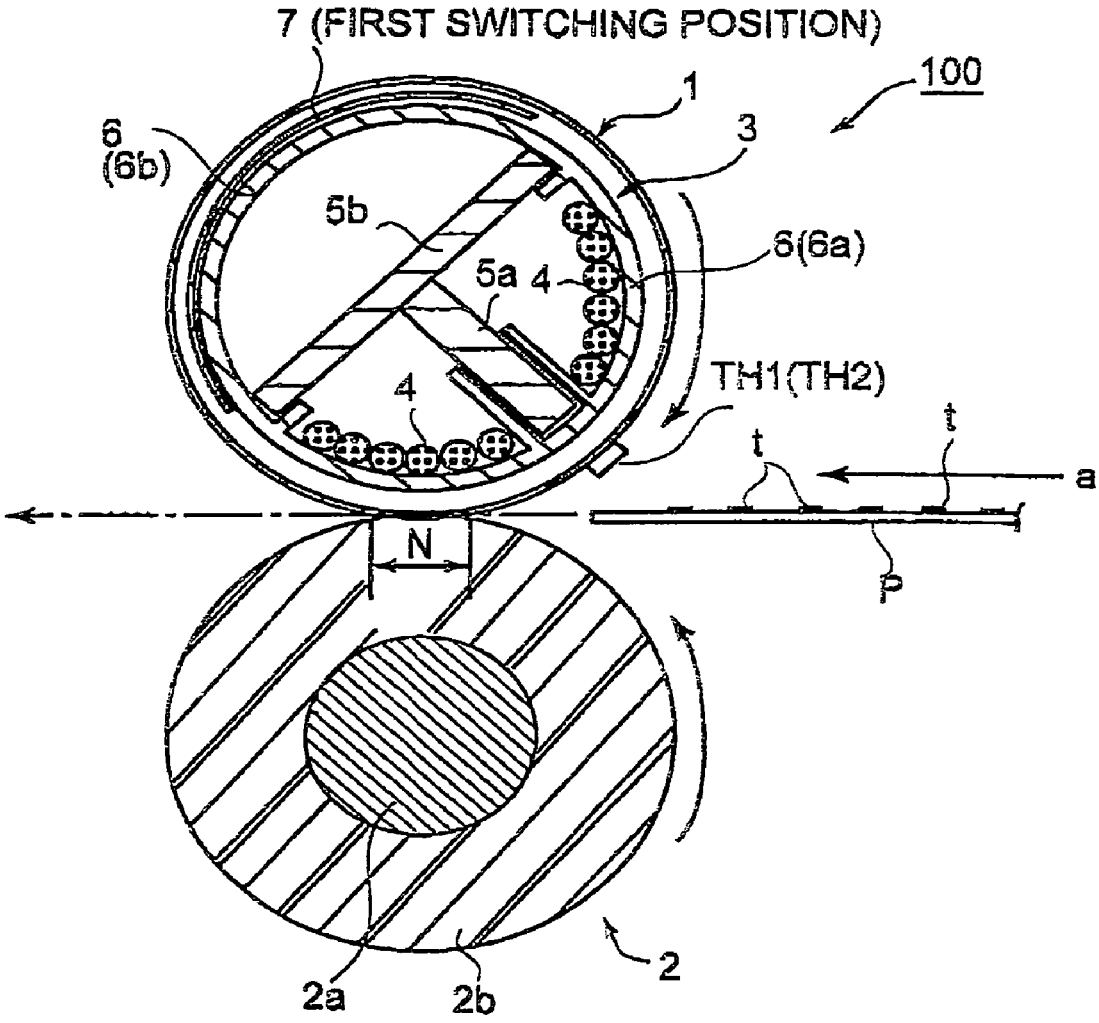
FIG. 3 is an enlarged schematic cross-sectional view of the essential portions of the fixing apparatus.
Figure 4:
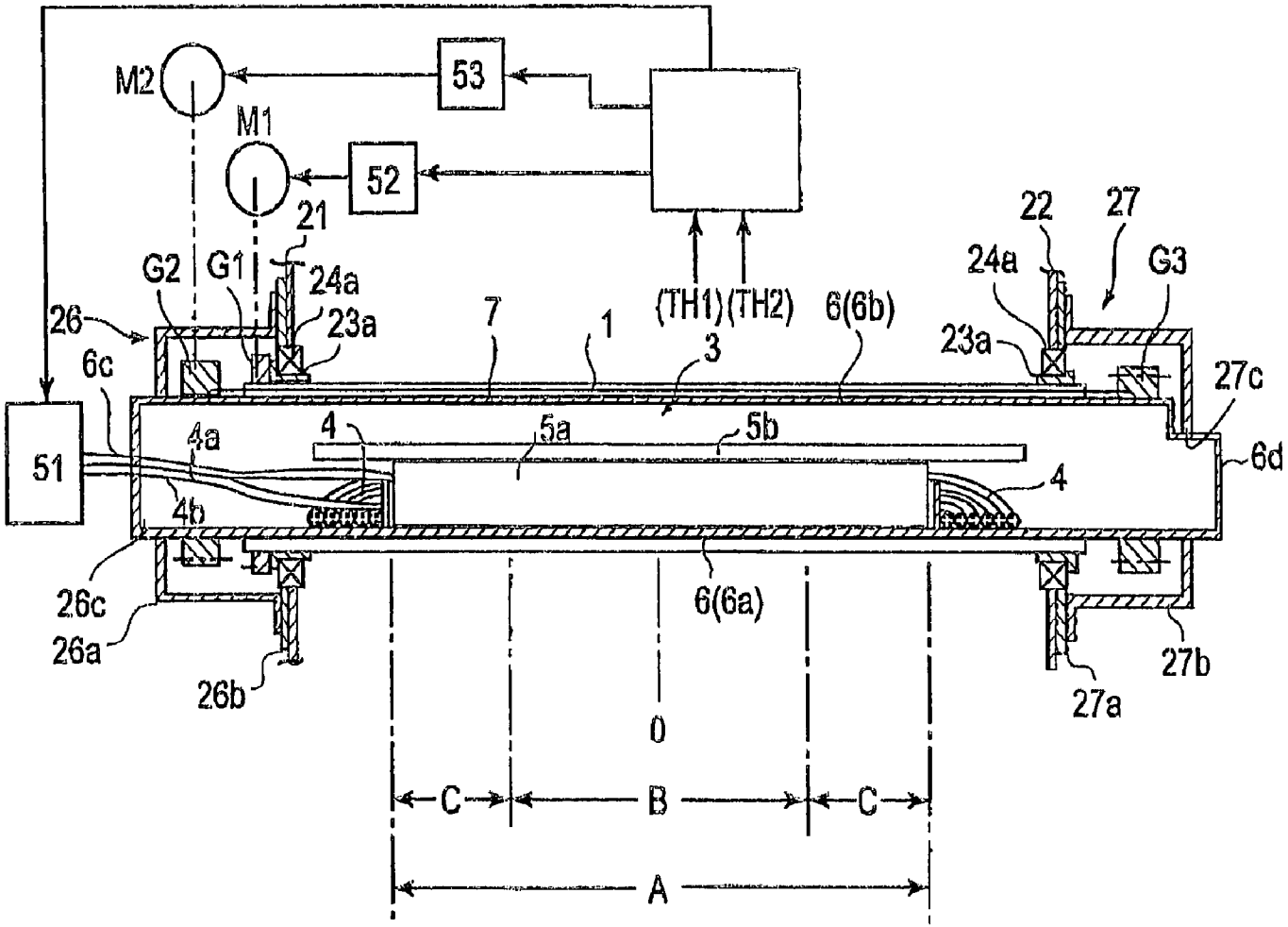
FIG. 4 is a schematic vertical sectional view of the fixation roller assembly of the fixing apparatus.

FIG. 2 is a schematic front view of the essential portions of the fixing apparatus, and FIG. 3 is an enlarged schematic cross-sectional view of the essential portions of the fixing apparatus. FIG. 4 is a schematic vertical sectional view of the fixation roller assembly portion of the fixing apparatus.

For the degree of accuracy at which the fixation roller, as a member in which heat can be generated by electromagnetic induction, is positioned relative to an excitation coil assembly as a magnetic flux generating means (heating means), the fixing apparatus in this embodiment is structured so that the fixation roller and excitation coil assembly are coaxially supported by the positioning members, inclusive of the means for accurately positioning the supporting member for rotatably supporting the fixation roller and the means for accurately positioning the excitation coil assembly.

Designated by a referential symbol 1 is the fixation roller as a member in which heat can be generated by electromagnetic induction. The fixation roller 1 is formed of such a substance as iron, nickel, and SUS 430 (electrically conductive magnetic substance), in which heat can be generated by electromagnetic induction. It is a cylindrical, and the thickness of its wall is in the range of 0.1 mm-1.5 mm. Generally, it comprises a toner releasing layer as the surface layer, or the combination of a toner releasing layer, an elastic layer, etc. Using one of the ferromagnetic metals (metallic substances with high level of permeability), as the material for the fixation roller, makes it possible to confine a larger portion of the magnetic flux generated by the magnetic flux generating means, in the wall of the fixation roller 1. In other words, it makes it possible to increase the fixation roller in magnetic flux density, making it thereby possible to more efficiently induce eddy current in the surface portion of the metallic fixation roller.

This fixing apparatus 100 is provided with a front plate 21, a rear plate 22, a fixation roller supporting front member 28 (fixation roller positioning plate), a fixation roller supporting rear member 27 (fixation roller positioning plate). To the outward surfaces of the fixation roller supporting members 26 and 27, first supporting portions 26*a* and 27*a* are attached, respectively. The fixation roller 1 is provided with a pair of heat insulating bushings 23*a* and 23*b*, which are fitted around the lengthwise front and rear end portions of the fixation roller 1, respectively. It is rotatably supported at the front and rear lengthwise end portions by the portions 26*a* and 27*a* of the front and rear supporting members 26 and 27, with the interposition of bearings 24*a* and 24*b* disposed between the bushing 23*a* and the portion 26*a* of the front supporting member 26, and between the bushing 23*b* and portion 27*a* of the rear supporting member 27, respectively.

Figure 7:
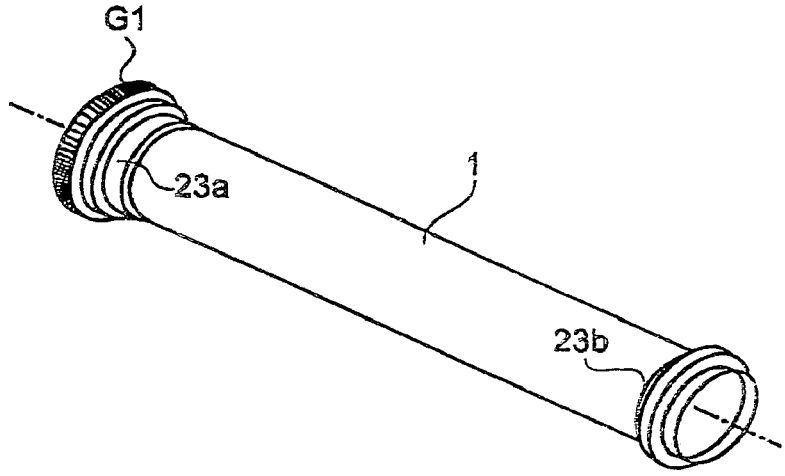
FIG. 7 is an external perspective view of the fixation roller to which the thermally insulating bushings and fixation roller gear have been attached.

The heat insulating bushings 23*a* and 23*b* are employed to minimize the heat transmission from the fixation roller 1 to the bearings 24*a* and 24*b*. Designated by a referential symbol G1 is a fixation roller driving gear fitted fast around the front end portion of the fixation roller 1. As the rotational force from a first motor M1 is transmitted to this gear G1 through a driving force transmission system (unshown), the fixation roller 1 is rotationally driven at a preset peripheral velocity in the clockwise direction indicated by an arrow mark in FIG. 3. FIG. 7 is an external perspective view of the fixation roller 1 fitted with the pair of heat insulating bushings 23*a* and 23*b* and tie fixation roller gear G1.

Designated by a referential symbol 2 is a pressure roller as a pressure applying member, which is an elastic roller made up of a metallic core 2*a*, a cylindrical elastic layer 2*b* fitted integrally and concentrically around the metallic core 2*a*, etc. The elastic layer 2*b* is a layer formed of a rubbery substance, for example, silicone rubber, which displays the releasing property and is heat resistant. This elastic roller 2 is disposed under the fixation roller, in parallel to the fixation roller, being rotatably supported by the front and rear end portions of the metallic core 2*a*, with a pair of bearings 25*a* and 25*b* attached to the front and rear plates 21 and 22, respectively, in such a manner that they can be slid toward the fixation roller 1. Further, the bearings 25*a* and 25*b* are kept pressured upward toward the fixation roller 1 by a pair of pressure applying means (unshown). With the provision of the above described structural arrangement, the pressure roller 2 is pressed against the downwardly facing portion of the peripheral surface of the fixation roller 1, so that a preset amount of contact pressure is maintained between the fixation roller 1 and pressure roller 2 against the elasticity of the elastic layer 2*b*. As a result, a fixation nip N, as a heating nip, with a preset width is formed between the fixation roller 1 and pressure roller 2. As the fixation roller 1 is rotationally driven, the pressure roller 2 is rotated by the friction which occurs between the fixation roller 1 and pressure roller 2 in the fixation nip N.

Figure 8:
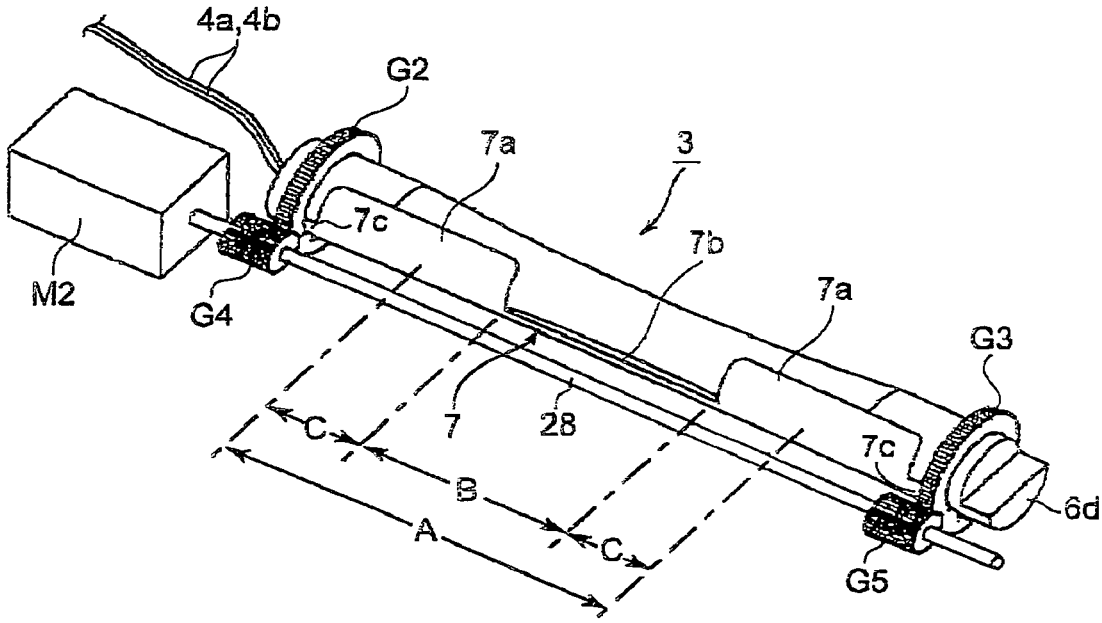
FIG. 8 is an external perspective view of the excitation coil assembly and the means for moving the magnetic flux adjusting member.
Figure 9:
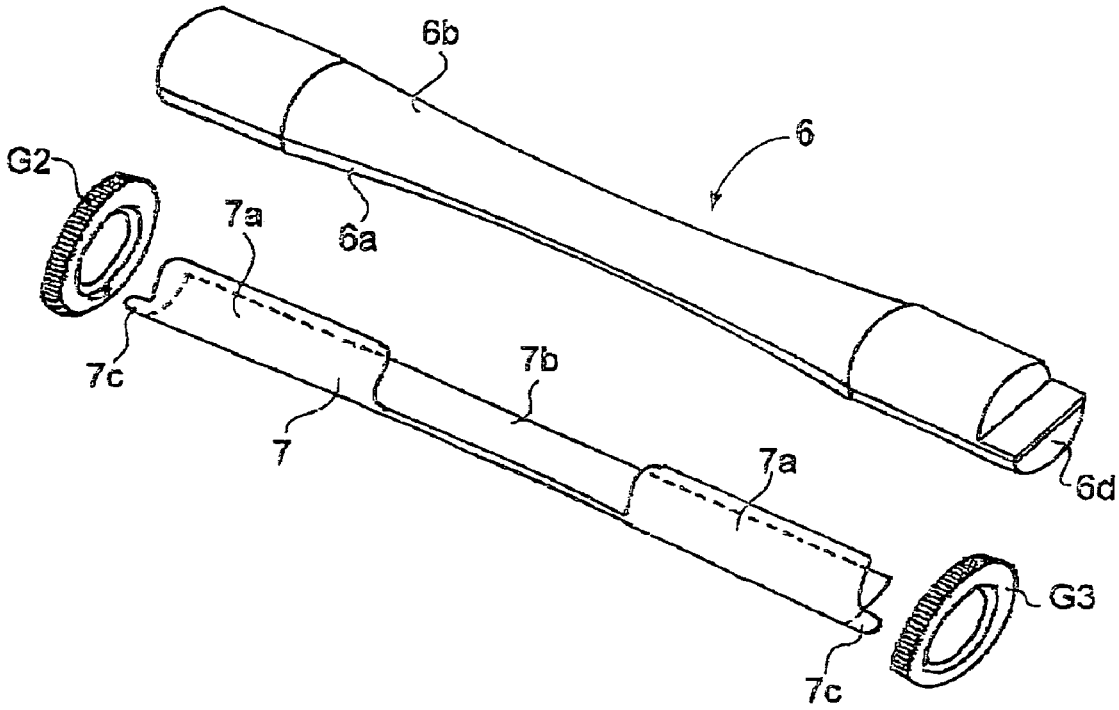
FIG. 9 is an exploded perspective view of the holder and magnetic flux adjusting member.

Designated by a referential symbol 3 is an excitation coil assembly as a magnetic flux generating means. This excitation coil assembly 3 is disposed in the hollow of the above-mentioned cylindrical fixation roller 1. The excitation coil assembly 3 is made up of an excitation coil 4 (which hereinafter will be referred to simply as coil), magnetic cores 5*a* and 5*b* (which hereinafter will be referred to simply as cores), and a holder 6. The magnetic cores 5*a* and 5*b* are integrally attached to each other, yielding a component with a T-shaped cross section, and are disposed in the hollow of the holder 6. The excitation coil assembly 3 is also provided with a magnetic flux adjusting member 7 (magnetic flux blocking member (magnetic flux reducing member): shutter), which is rotatably disposed on the outward side of the holder 6, coaxially with the holder 6. FIG. 8 is an external view of this excitation coil assembly 3 and means M2, 28, G4, and G5 for moving the magnetic flux adjusting member 7. FIG. 9 is an exploded perspective view of the holder 6 and magnetic flux adjusting member 7 FIG. 10 is an exploded perspective view of the holder 6, and the components therein.

Hereinafter, the lengthwise direction of the structural components or the portions thereof of the fixing apparatus means the direction perpendicular (intersectional) to the recording medium conveyance direction a.

The holder 6 is roughly cylindrical in cross section, from one lengthwise and to the other. As the material therefor, a mixture of PPS resin, which is heat resistant and has mechanical strength, and glass fiber, is used. As for the substances, other than the PPS resin, suitable as the material for the holder 6, PEEK resin, polyimide resin, polyamide resin, polyamide-imide resin, ceramic, liquid polymer, fluorinated resin, and the like are available.

Figure 10:
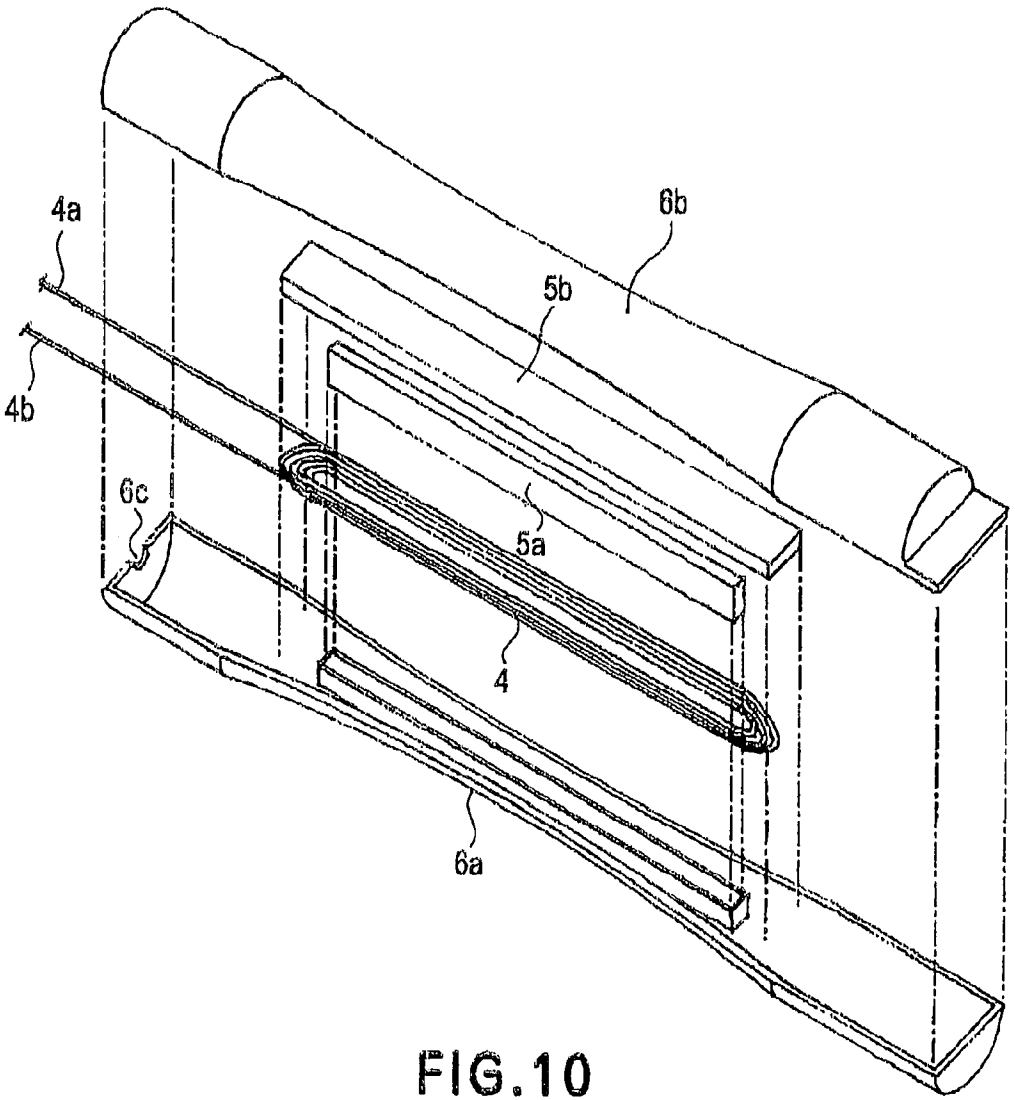
FIG. 10 is an exploded perspective view of the holder and the components therein.

Referring to FIG. 10, the holder 6 is made up of two (first and second) roughly semicylindrical portions 6*a* and 6*b*, which are attached to each other with adhesive, or are interlocked to each other by providing the two portions 6*a* and 6*b* with such a shape that makes it possible to interlock the two portions 6*a* and 6*b* with each other, to form the holder 6, which is roughly cylindrical, from one lengthwise end to the other. The coil 4 and cores 5*a* and 5*b* are disposed in the first semicylindrical portion 6*a*, and then, the second semicylindrical portion 6*b* is bonded to the first semicylindrical portion 6*a* in a manner of encasing the coil 4 and core 5*a* and 5*b*, completing the holder 6 which internally holds the coil 4 and core 5*a* and 5*b*. Designated by referential symbols 4*a* and 4*b* are lead wires, which are extended outward from the holder 6 through a hole 6*c* of the front end wall of the holder 6.

Also referring to FIG. 10, the coil 4 has a roughly elliptical shape (shape of long and narrow boat), the major axis of which is parallel to the lengthwise direction of the fixation roller 1. It is disposed in the hollow of the first semicylindrical portion 6*a* of the holder 6 so that its external contour follows the internal surface of the fixation roller 1. The coil 4 must be capable of generating an alternating magnetic flux strong enough to generate a sufficient amount of heat for fixation. Therefore, the coil 4 must be small in electrical resistance, and high in inductance. As the wire for the coil 4, Litz wire is used, which is made by bundling roughly 80-160 strands of fine wires, the diameter or which is in the range of 0.1-0.3 mm. The Litz wire is wound 6-12 times around the first core 5*a*.

The core 5*a* constitutes a first core (equivalent to vertical portion of letter T) around which the Litz wire is wound. The core 5*b* constitutes a second core (equivalent to horizontal portion of letter T). The two cores 5*a* and 5*b* are attached to each other so that the resultant component will be T-shaped in cross section. As the material for the cores 5*a* and 5*b*, such a substance as ferrite that is high in permeability, and yet, is low in residual magnetic flux density, is preferable. However, the only requirement for the material for the cores 5*a* and 5*b* is that the material is capable of generating magnetic flux. In other words, what as required of the material for the cores 5*a* and 5*b* is not particularly restrictive. Further, the cores 5*a* and 5*b* are not required to be in a specific forms or be made of a specific material. Moreover, the first and second core 5*a* and 5*b* may be formed as parts of a single piece magnetic core, which is T-shaped in cross section.

Referring to FIG. 9, the magnetic flux adjusting member 7 is shaped 30 that its cross section is arcuate, from one lengthwise end to the other. It has a pair of shutter portions 7*a* and 7*a* having the arcuate cross section, and a connective portion 7*b* having also the arcuate cross section and being narrower than the shutter portions 7*a* in terms of the circumferential direction of the fixation roller (holder). In terms of the lengthwise direction of the magnetic flux adjusting member 7, the shutter portions 7*a* and 7*a* are the portions adjacent to the lengthwise ends of the magnetic flux adjusting member 7, and the connective portion 7*b* is the center portion of the magnetic flux adjusting member 7, which connects the shutter portions 7*a* and 7*a*. As for the material for the magnetic flux adjusting member 7, such a nonferrous metallic substance as aluminum, copper, or the like is used as the material for the magnetic flux adjusting member 7, and among nonferrous metallic substances, those which are lower in electrical resistance are preferable. The magnetic flux adjusting member 7 is also provided with a pair of protrusions 7*c* and 7*c*, which protrude from the outward edges of the shutter portions 7*a* and 7*a*, one for one, in the lengthwise direction of the magnetic flux adjusting member 7. These protrusions 7*c* and 7*c* are engaged with the first and second shutter gears G2 and G3*c* rotatably fitted around the front and rear end portions of the holder 6. With the provision of the above described structural arrangement, the magnetic flux adjusting member 7 is held at both of its lengthwise ends by the first and second shutter gears G2 and G3, between the first and second shutter gears G2 and G3.

The fixing apparatus 100 is structured so that the holder 6 of the excitation coil assembly 3 is supported as shown in FIGS. 2 and 4. That is, one of the lengthwise end portions of the cylindrical holder 6 is extended outward beyond the front end of the fixation roller 1, through the front opening of the fixation roller 1, and is fitted in the hole 26*c* of the second portion 26*b* of the front supporting member 26 attached to the outboard side of the front plate 21 of the fixing apparatus 100, being thereby supported by the front plate 21. The other lengthwise end portion of the holder 6 is extended outward beyond the rear end of the fixation roller 1, through the rear opening the fixation roller 1, and is fitted in the hole 27*c* of the second portion 27*b* of the rear supporting member 27 attached to the outward side of the rear plate 22 of the fixing apparatus 100, being thereby supported by the rear plate 22. More specifically, the rear end portion of the holder 6 is provided with a D-cut portion 6*d*, and the hole 27*c* of the rear supporting member 27 is D-shaped in cross section. Therefore, the holder 6 is nonrotationally supported by the front and rear plates 26 and 27 or the fixing apparatus 100. Also with the provision of the above described structural arrangement, the holder 6 is disposed in the hollow of the fixation roller 1 so that the two are roughly coaxially disposed while providing a preset amount of gap between the peripheral surface of the holder 6 and internal surface of the fixation roller 1, and also, so that the holder 6 is nonrotationally held in a preset attitude, that is, at a preset angle in terms of its circumferential direction. The aforementioned lead wires 4*a* and 4*b* extending outward from the holder 6 through the hole 6*c*, with which the front end wall of the holder 6 is provided, are connected to an excitation circuit 51.

Incidentally, regarding the means for nonrotationally holding the holder 6 at the aforementioned angle (position) in terms of its circumferential direction, in this embodiment, the D-cut end portion 6*d* of the holder 6 is fitted in the hole 27*c* of the portion 27*b* of the second supporting member 27, which is D-shaped in cross section. However, the means for nonrotationally holding the holder 6 at the preset angle (position) does not need to be limited to the above described one. That is, any means will suffice as long as the holder 6 can be nonrotationally held at the preset angle (position) in terms of its circumferential direction.

As described above, the magnetic flux adjusting member 7 is supported between the first and second shutter gears G2 and G3, by being supported at both of its lengthwise ends by the gears G2 and G3. That is, the protrusions 7*c* and 7*c* (FIGS. 8 and 9), which are the actual lengthwise end portions of the magnetic flux adjusting member 7, are supported by the first and second shutter gears G2 and G3 by being engaged with the first and second shutter gears G2 and G3, respectively, which are rotatably fitted around the front and rear end portions of the holder 6. Thus, as the first and second shutter gears G2 and G3 are rotated by the means M2, 28, G4, and 5 for moving the magnetic flux adjusting member 7, the magnetic flux adjusting member 7 is roughly coaxially rotated about the axial line of the holder 6, through the cylindrical gap between the peripheral surface of the holder 6 and the internal surface of the fixation roller 1.

Referring to FIG. 8 which depicts the means M2, 28, G4, and G5 for moving the magnetic flux adjusting member 7, a referential symbol M2 stands for a second motor; 28: a shaft; G4: first output gear; and a referential symbol G5 stands for a second output gear The shaft 28, which is located outside the fixation roller 1, is rotatably supported in parallel to the fixation roller 1, by the front and rear plates 21 and 22 of the fixing apparatus 100, with a pair of bearings (unshown) placed between the shaft 28 and the plates 21 and 22. The second motor M2 is a driving force source for rotating the shaft 28, and is a stepping motor. The first and second output gears G4 and G5 are rigidly and coaxially attached to the shaft 28. The first and second output gears G4 and G5 are meshed with the first and second shutter gears G2 and G3 of the excitation coil assembly 3, respectively Thus, as the second motor M2 is rotationally driven, the rotational force is transmitted to the first and second shutter gears G2 and G3, causing thereby the magnetic flux adjusting member 7 to rotate roughly about the axial line of the holder 6 in a manner to follow the peripheral surface of the holder 6. As for the material for the gears, one of the various resinous substances may be selected according to the ambient temperature, and the amount of torque to which they are subjected.

Referring to FIG. 2, designated by a referential symbol 50 is a control circuit portion (CPU), which activates the first motor M1 with a preset control timing, through a driver 52, according to an image formation sequence. As the first motor M1 is activated, the rotational force is given to the driving gear G1 of the fixation roller 1, rotationally driving the fixation roller 1 in the clockwise direction indicated by an arrow mark in FIG. 3. The pressure roller 2 is rotated by the rotation of the fixation roller 1.

The control circuit portion 50 also activates the exciting circuit 51 with a preset timing, supplying thereby the coil 4 with alternating electric current. As a result, an alternating magnetic flux (alternating magnetic field) is generated, and therefore, heat is generated in the wall of the fixation roller 1 by electromagnetic induction, causing the fixation roller 1 to increase in temperature.

Figure 6:
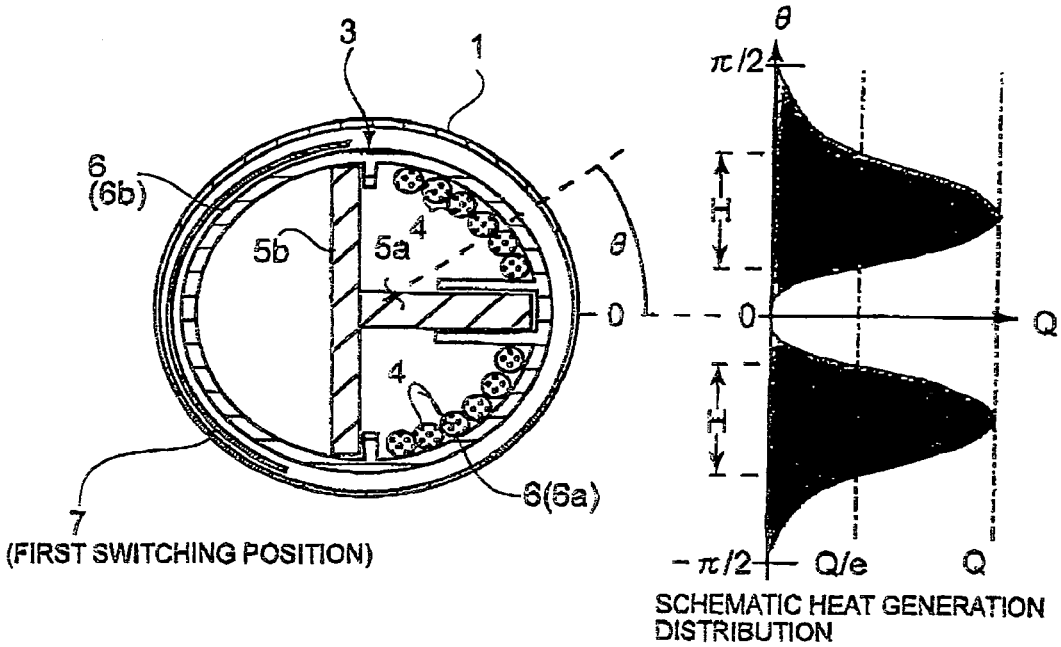
FIG. 6 is a drawing showing the primary area across which a magnetic flux is generated, and the heat distribution of the fixation roller, corresponding to the primary area, in terms of the direction parallel to the circumferential direction of the fixation roller.

FIG. 6 is the combination of a schematic cross-sectional view of the fixation roller 1 in the system such as the above described one, and a graph showing the heat distribution of the fixation roller 1 in the heated condition. It shows the areas to which the major portion of the magnetic flux generated by the magnetic flux generating means concentrates, and the corresponding heat distribution of the fixation roller 1, in terms of the circumferential direction of the fixation roller 1. As alternating electric current is flowed through the coil 4, the coil 4 generates an alternating magnetic flux. The fixation roller 1 is formed of a magnetic metal or nonmetallic magnetic substance. Within the wall of the fixation roller 1, eddy current is induced in a manner to neutralize the magnetic field. This eddy current generates neat (Joule heat) in the wall of the fixation roller 1, increasing thereby the fixation roller 1 in temperature.

In the case of the structure of the fixing apparatus in this embodiment, the area in which the major portion of the magnetic flux is generated is on the outward side of the first semicylindrical portion 6*a* of the holder 6, in which the coil 4 and cores 5*a* and 5*b* are disposed. Thus, the portion of the fixation roller 1, which is in this area, is where heat is generated by the magnetic flux. The heat distribution of the fixation roller if in terms of the circumferential direction of the fixation roller 1, across the portion in the abovementioned magnetic flux generation area, has two areas H and H, in which most of the heat is generated, as shown in FIG. 6. In this embodiment, the holder 6 is nonrotationally held (positioned) at such an angle in terms of the circumferential direction of the holder 5 that the portion of the coil 4, which corresponds to one of the two areas H and H, faces the fixation nip N, and the portion of the coil 4, which corresponds to the other of the two areas H and H, faces the immediate adjacencies of the fixation nip N on the upstream side in terms of the rotational direction of the fixation roller 1.

When the magnetic flux adjusting member 7, which is in the cylindrical gap between the peripheral surface of the holder 6 and the internal surface of the fixation roller 1, is not required to adjust the magnetic flux, it is moved into, and kept in, the position shown in FIGS. 3 and 6, which is on the opposite side of the fixing apparatus from the aforementioned areas in which the major portion of the magnetic flux is generated. This area of the gap in which the magnetic flux adjusting member 7 is kept when the magnetic flux adjusting member 7 is not required to adjust the magnetic flux is where the magnetic flux from the magnetic flux generating means is virtually nonexistent, or extremely low in density. This position shown in FIGS. 3 and 6, in which the magnetic flux adjusting member 7 is kept when the magnetic flux adjusting member 7 is not required to adjust the magnetic flux, will be referred to as first position.

The temperature of the fixation roller 1 is detected by a central thermistor TH1 as a temperature detecting means, disposed at the roughly mid point of the fixation roller 1 in terms of the lengthwise direction thereof, in contact, or with no contact, with the fixation roller 1, and the detected temperature is inputted into the control circuit 50, which controls the temperature of the fixation roller 1 by controlling the electric power supplied from the exciting circuit 51 to the coil 4, so that the fixation roller temperature detected by the central thermistor TH1 and inputted into the control circuit 50 remains at a preset target temperature (fixation temperature). While the magnetic flux adjusting member 7 is kept in the first position shown in FIGS. 3 and 6, the fixation roller 1 is controlled in temperature so that the temperature of the fixation roller 1 is kept at the target level across the entirety of its effective range (heatable range) in terms of its lengthwise direction.

While the fixation roller temperature is kept at the preset fixation level after being raised thereto, a recording medium P bearing an unfixed toner image t is introduced into the fixation nip N, and is conveyed through the fixation nip N while being kept pinched by the fixation roller 1 and pressure roller 2 As the recording medium P is conveyed through the fixation nip N, the unfixed toner image t on the recording medium P is fixed to the surface of the recording medium 2 by the heat from the fixation roller 1 and the pressure in the fixation nip N.

Hereinafter, the term, recording medium width, means the dimension of a recording medium, in terms of the direction perpendicular to the recording medium conveyance direction a, when the recording medium P is completely flat. As described above, in this embodiment, the recording medium P is conveyed through the fixing apparatus (image forming apparatus) so that the center of the recording medium P in terms of its width direction coincides with the center of the fixing apparatus (fixation roller 1) in terms of the width direction of the recording medium P. Referring to FIGS. 2 and 4, designated by a referential symbol O is the centerline (hypothetical line), as the referential line, of the fixation roller 1 (recording medium) in terms of its lengthwise direction, and designated by a referential symbol A is the width of the path of the largest recording medium, in terms of width, usable with the image forming apparatus. Designated by a referential symbol B is the width of the path of a recording medium which is one size smaller than the largest recording medium. Hereinafter, a recording medium smaller in width than the largest recording medium will be referred to simply as a recording medium of the small size. Designated by a referential symbol C are the areas between the edges of a recording medium of the large size and the edge of a recording medium of the small size. In other words, each of the areas C is the portion of the recording medium passage, which does not come into contact with a recording medium of the small size when the recording medium of the small size is conveyed through the fixing apparatus. Since a recording medium is conveyed through the fixing apparatus so that the center of the recording medium in terms of its width direction coincides with the center of the fixation roller 1 in terms of its lengthwise direction, there will be two areas C, one on the left side of the path B of a recording medium of the small size, and the other on the right side of the path B of a recording medium of the small size. The width of the areas C is changed by the width of the recording medium being conveyed through the fixing apparatus (image forming apparatus).

The abovementioned central thermistor TH1 used for controlling the temperature of the fixation roller 1 is disposed within the path B of a recording medium of the small size so that it will be within the path of a recording medium regardless of recording medium width.

Designated by a referential symbol TH2 is a peripheral thermistor as a temperature detecting means disposed within one of the area C, that is, the areas out-of-path of a recording medium, in terms of the lengthwise direction of the fixation roller 1, in contact, or with no contact, with the fixation roller 1, in order to detect the increase in the temperature of the fixation roller 1, across the portions corresponding to the out-of-path areas C. The temperature data obtained by this peripheral thermistor TH2 are also inputted into the control circuit portion 50.

As multiple recording medium of the small sizes are consecutively conveyed through the fixing apparatus 100, the portions of the fixation roller 1 corresponding in position to the out-of-path areas C increases in temperature, and this increase in temperature is detected by the peripheral thermistor TH2, and the detected increase in temperature is inputted from the thermistor TH2 to the control circuit portion 50. As the temperature level of the out-of-path area C inputted into the control circuit portion 50 by the peripheral thermistor TH2 exceeds the preset permissible range, the control circuit portion 50 rotates the magnetic flux adjusting member 7 from the first position shown in FIGS. 3 and 6 into the second position shorn in FIG. 5 by activating the second motor M2 through the driver 53.

The second position for the magnetic flux adjusting member 7 is such a position that when the magnetic flux adjusting member 7 is in this position, the arcuate shutter portions 7*a* and 7*a*, that is, the virtual end portions of the magnetic flux adjusting member 7 in its lengthwise direction, which are wider, in terms of the circumferential direction of the fixation roller 1, than the connective portion 7*b*, that is, the center portion of the magnetic flux adjusting member 7, are in the following positions. That is, the arcuate shutter portions 7*a* and 7*a* of the magnetic flux adjusting member 7 which is in the cylindrical gap between the peripheral surface of the holder 6 and the internal surface of the fixation roller 1, are placed in the portions of the above described gap, one for one, which correspond in position to the out-of-path areas C in terms of the lengthwise direction of the fixation roller 1, and also, to the area in which the major portion of the magnetic flux is generated, in terms of the circumferential direction of the fixation roller 1.

With the magnetic flux adjusting member 7 placed in the second position, the magnetic flux from the magnetic flux generating means is reduced in the amount by which it acts on the portion of the fixation roller 1 which corresponds in position to the out-of-path areas C and C. Therefore, the portions of the fixation roller 1 corresponding to the out-of-path areas C are minimized in the amount by which heat is generated therein. Therefore, the problem that the portions of the fixation roller 1 corresponding to the out-of-path areas C increase in temperature is prevented.

Figure 5:
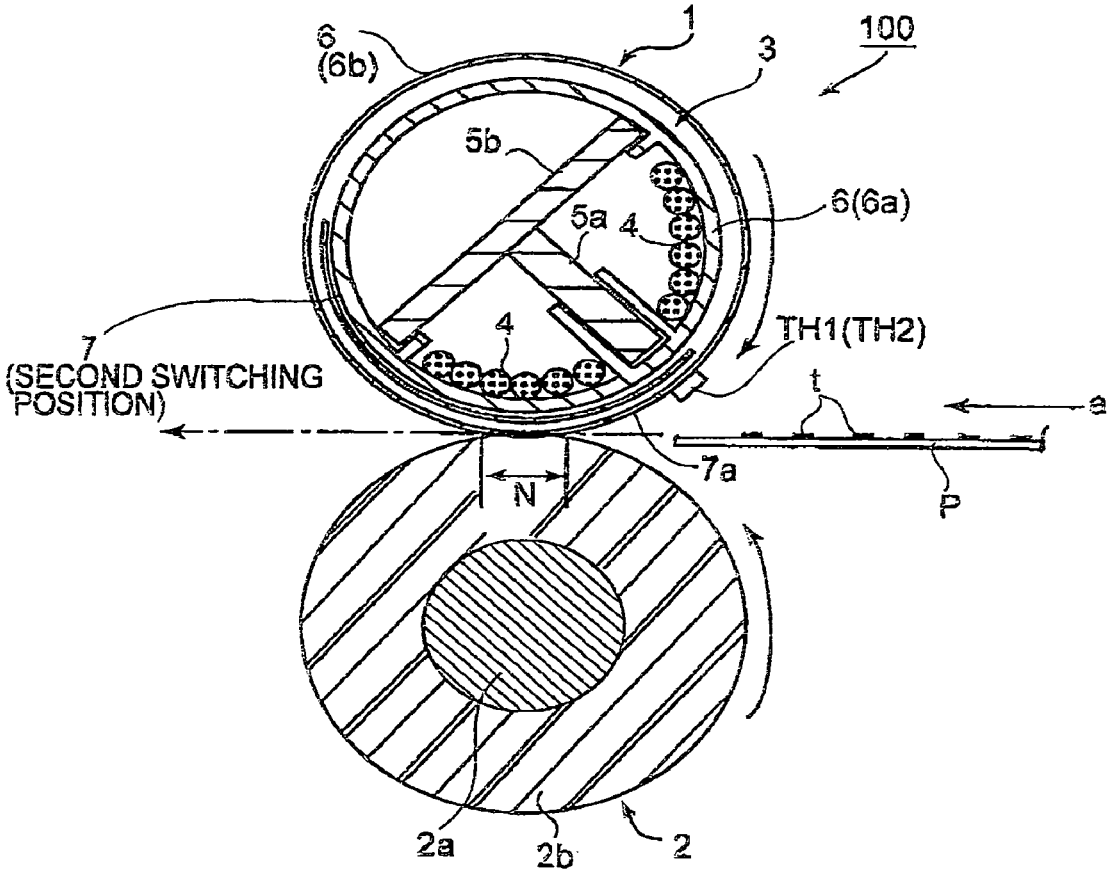
FIG. 5 is an enlarged schematic cross-sectional view of the essential portions of the fixing apparatus in the condition in which the magnetic flux adjusting member is being rotated into the second position.

It is possible to structure the fixing apparatus 100 so that as the magnetic flux adjusting member 7, which is in the gap between the peripheral surface of the holder 6 and the internal surface or the fixation roller 1, is moved into the aforementioned second position, the shutter portions 7*a* and 7*a*, which correspond in position to the out-of-path areas C and C, extend from one end of the magnetic flux generation area, in terms of the circumferential direction of the fixation roller 1 (holder 6), to the other, or a part of the way to the other. FIG. 5 shows the structural arrangement in which the shutter portions 7*a* and 7*a* extend from one end of the magnetic flux generation area roughly halfway to the other.

As the magnetic flux adjusting member 7 is rotationally moved into the second position, the portions of the fixation roller 1 corresponding to the out-of-path areas C gradually reduce in temperature As the temperature level of these portions inputted into the control circuit portion 50 by the peripheral thermistor TH2 falls below the preset permissible level, that is, as it is detected that the portions of the fixation roller 1 corresponding to the out-of-path areas C have become too low in temperature, the control circuit portion 50 rotationally moves the magnetic flux adjusting member 7 into the first position to prevent these portions of the fixation roller 1 from becoming too low in temperature.

Further, if an image forming operation which uses recording mediums of a small size is switched to an image forming operation which uses recording mediums of a large size after the magnetic flux adjusting member 7 is moved into the second position during the image forming operation using the recording mediums of the small size, the control circuit portion 50 rotates the magnetic flux adjusting member 7 back into the first position.

As one of the methods for securing a proper amount of gap between the fixation roller 12 as an inductively heatable member and magnetic flux adjusting member 7, there is the method which widens the distance (gap) between the magnetic flux adjusting member 7 and fixation roller 1. However, this method suffers from the following problem. That is, as the distance between the magnetic flux adjusting member 7 and fixation roller 1 is increased, the distance between the core 5 and fixation roller 1 increases, and if the distance between the core 5 and fixation roller 1 is increased beyond a certain value, heat exchange efficiency drastically drops. Therefore, currently, this method is seldom used. The holder 6 is extended, in terms of the circumferential direction of the fixation roller 1, to the opposite side of the fixation roller 1 from where the coil 4 is disposed, making the holder 6 roughly circular in cross section, from one lengthwise end to the other. Shaping the holder 6 as described above makes it possible to make the rotational axes of the holder 6, fixation roller 1, and magnetic flux adjusting member 7 coincide, making it therefore possible to improve the fixing apparatus 100 in terms of the accuracy with which these components are positioned relative to each other.

As for the means for transmitting the force for driving the magnetic flux adjusting member 7, the front and rear lengthwise end portions of the holder 6 are fitted with the first and second shutter gears G2 and G3, which are rotatable around the holder 6, as described above. Further, the magnetic flux adjusting member 7 is provided with the aforementioned protrusions 7*c*, which protrude outward from the outward edges of the magnetic flux adjusting member 7. These protrusions 7*c* are engaged with the first and second shutter gears G2 and G3 so that the magnetic flux adjusting member 7 is supported at both of its lengthwise ends, between the gears G2 and G3, by the gears G2 and G3. The shutter gears G and G3 are engaged with (fitted around) the holder 6 by the portions which are not engaged with the protrusions 7*c* and 7*c* of the magnetic flux adjusting member 7. Therefore, the magnetic flux adjusting member 7 can be rotated by the gears G2 and G3, following the peripheral surface of the holder 6 while being supported by the entirety of the peripheral surface of the holder 6, and the internal surface of each of the gears G2 and G3. The portion of the holder 6, around which the gear G2 is fitted, and the portion of the holder 6, around which the gear G3 is fitted, are rendered uniform in external diameter across the portions largest in external diameter. Here, the expression that the portions of the holder 6, around which the gears G2 and G3 are fitted, one for one, are the largest in external diameter, means that as long as these portions remain largest in external diameter, these portions may be reduced in thickness, evenly or with preset intervals in terms of the circumferential direction thereof, in order to reduce the holder in weight. With the employment of this structural arrangement, as the holder 6 and magnetic flux adjusting member 7 are engaged with the gears G2 and G3, they are coaxially disposed, making it possible to improve the image heating apparatus in terms of the level of accuracy at which these components are positioned relative to each other.

Basically, the magnetic flux adjusting member 7 is arcuate in cross section from one lengthwise end to the other in terms of the lengthwise direction of the fixation roller 1. The lengthwise end portions of the magnetic flux adjusting member 7 are different in, dimension (in terms of circumferential direction of fixation roller 1: arc length in cross-sectional view) from the center portion of the magnetic flux adjusting member 7. When a recording medium of a small size is conveyed through the fixing apparatus, the magnetic flux adjusting member 7 is rotated so that the shutter portions 7*a* and 7*a*, that is, the lengthwise end portions, of the magnetic flux adjusting member 7 are moved into the areas where the magnetic flux is generated, in order to prevent the fixation roller 1 from increasing in temperature across the lengthwise end portions. Instead, the following method is possible. That is, the magnetic flux adjusting member 7 is shaped so that the center portion of the magnetic flux adjusting member 7 constitutes the magnetic flux blocking portion (shutter portion) which corresponds in position to the recording medium passage in terms of the lengthwise direction of the fixing apparatus and this shutter portion is moved into the magnetic flux generation area to change the magnetic flux in the distribution across the area which corresponds to the recording medium passage. In other words, the fixation roller 1 may be prevented from increasing in temperature across the lengthwise end portions, by changing the area corresponding to the recording medium path, and the areas corresponding to the areas outside the recording medium path, in the distribution of the amount by which heat is generated, in terms of the lengthwise direction of the fixation roller 1 (reverse shutter).

Next, referring to FIGS. 11-13, the front and rear supporting members 26 and 27 for supporting the fixation roller 1 and holder 6 by their front and rear end portions, respectively, will be described in somewhat more detail.

The front and rear supporting members 26 and 27 are attached to the front and rear plates 21 and 22 of the fixing apparatus 100, with the use of small screws which are put through the roughly round hole 26*d* and elongated hole 26*e* of the front supporting member 26, and the corresponding holes of the front plate 21 of the fixation apparatus, and through the roughly round hole 27*d* and elongated hole 27*e* of the rear supporting member 27, and the corresponding holes of the rear plate 22 of the fixing apparatus. Therefore, the fixation roller 1 and holder 6 can be easily replaced by removing the small screws.

Figure 11:
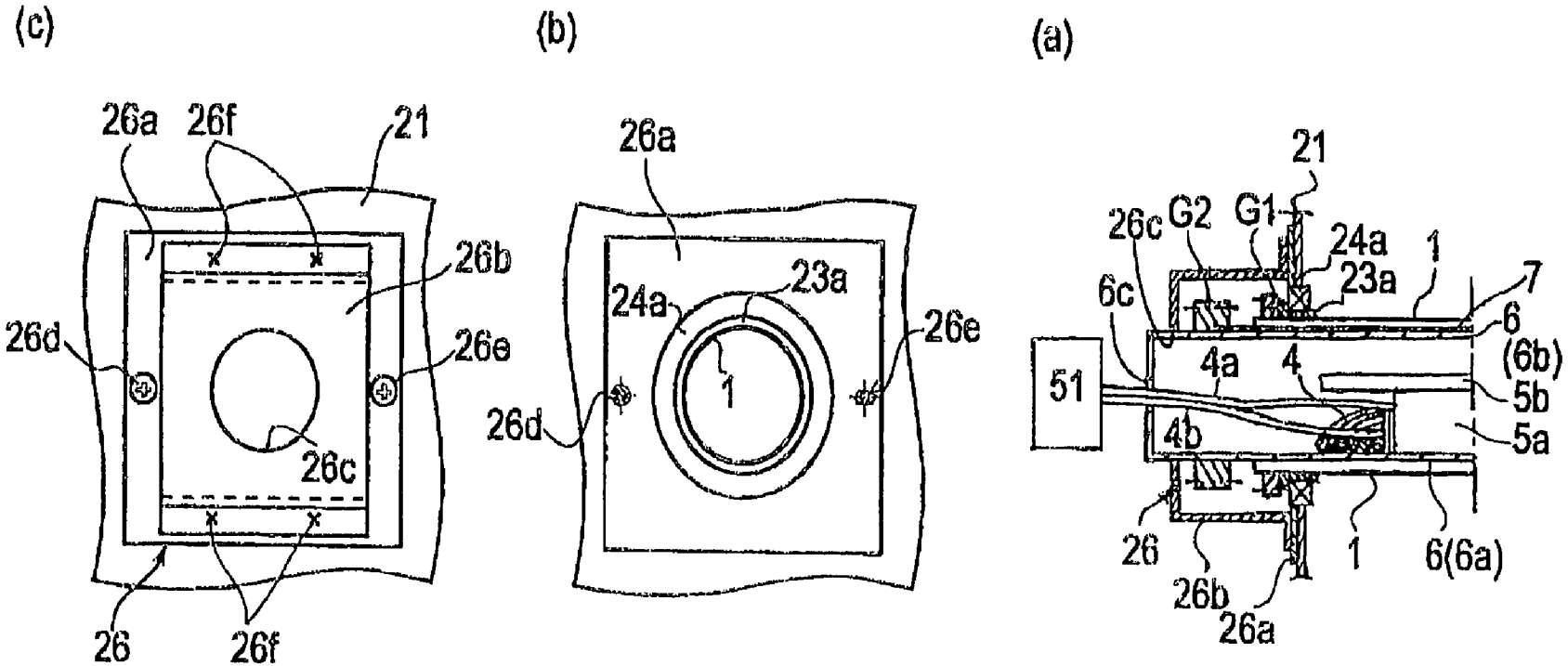
FIG. 11 is a drawing for describing the front supporting member for supporting fixation roller and holder, by their front end portions.

Referring to FIG. 11, the front supporting member 26 is made up of two portions: first and second portions 26*a* and 26*b*. The first portion 26*a* is provided with a round hole for supporting the bearing 24*a* by the front supporting member 26; the front end portion of the fixation roller 1 is fitted in this hole, with the heat insulating bushing 23*a* placed between the fixation roller 1 and the bearing 24*a*. The second portion 26*b* of the front supporting member 26 is provided with a round hole 26*c* for supporting the cylindrical front end portion of the holder 6.

Further, the first and second portions 26*a* and 26*b* of the front supporting member 26 are spot welded to each other at points 26*f*. As for the method for welding the two portions 26*a* and 26*b* to each other, the portions 26*a* and 26*b* are kept accurately positioned relative to each other with the use of a jig 61 as a means for facilitating the positioning of the portions 26*a* and 25*b* relative to each other, as shown in FIG. 13(*a*), and then, the two portions 26*a* and 26*b* are spot welded to each other. Therefore, it is possible to manufacture the front supporting member 26 capable of coaxially holding the fixation roller 1 and holder 6 at a high level of accuracy.

Figure 12:
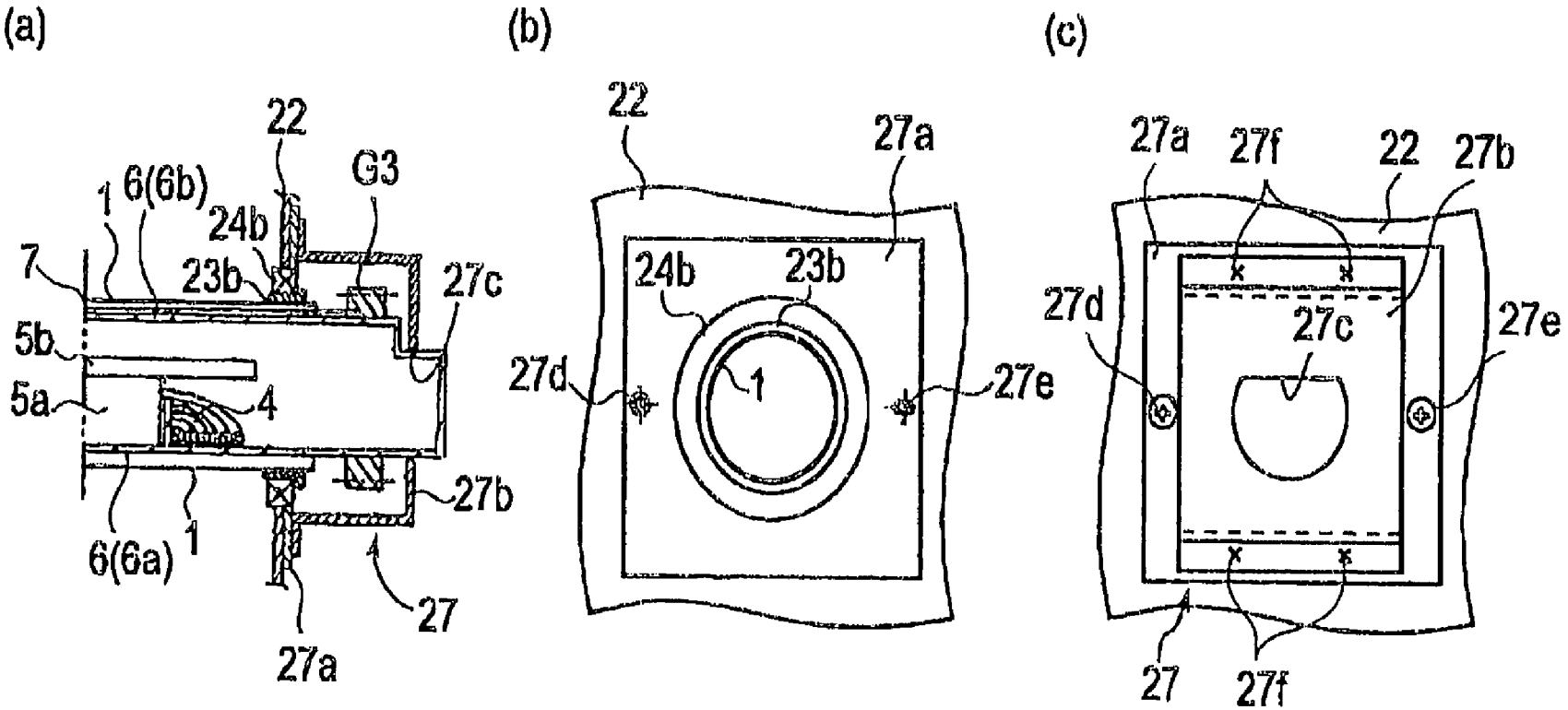
FIG. 12 is a drawing for describing the rear supporting member for supporting the fixation roller and holder, by their rear end portions.
Figure 13:
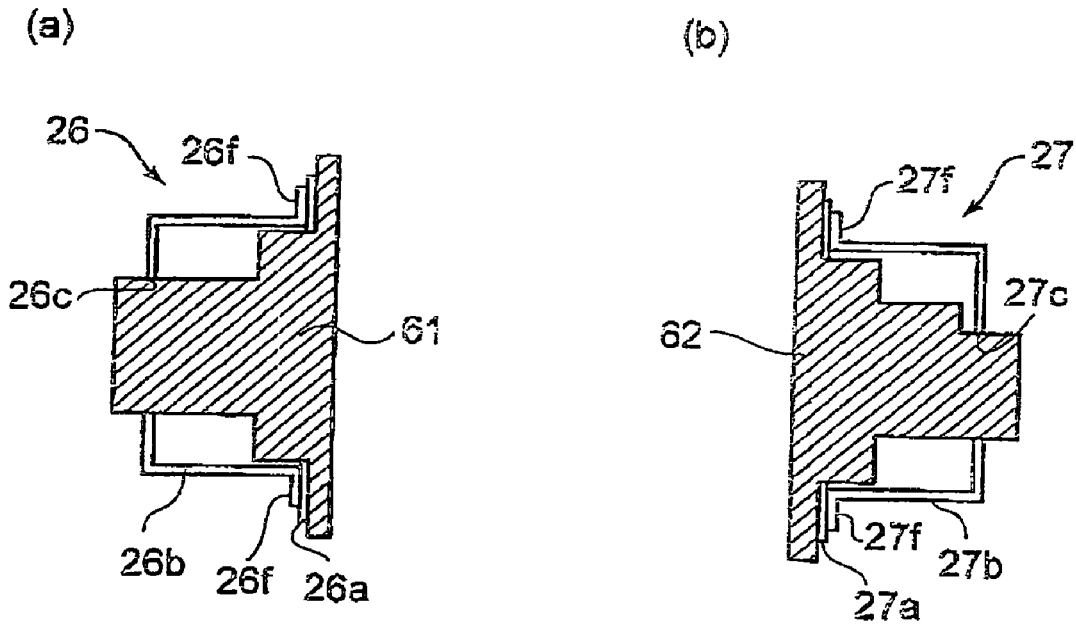
FIG. 13 is a drawing for describing the positioning means for precisely positioning the two portions of front supporting member relative to each other, and the positioning means for precisely positioning the two portion of the rear supporting member relative to each other.

Next, referring to FIG. 12, the rear supporting member 27 is also made up of two portions: first and second portions 27*a* and 27*b*. The first portion 27*a* is provided with a round hole for supporting the bearing 24*b* by the rear supporting member 27; the rear end portion of the fixation roller 1 is fitted in this hole, with the heat insulating bushing 23*b* placed between the fixation roller 1 and the bearing 24*b*. The second portion 27*b* of the rear supporting member 27 is provided with a D-shaped hole 27*c*, in which the rear end portion 6*d* of the holder 6, which is D-shaped in cross section, is fitted to prevent the holder 6 from rotating.

Further, the first and second portions 27*a* and 27*b* of the rear supporting member 27 are spot welded to each other at points 27*f*. As for the method for welding the two portions 27*a* and 27*b* to each other, the portions 27*a* and 27*b* are kept accurately positioned relative to each other with the use of a jig 62 as a means for facilitating the positioning of the portions 27*a* and 27*b* relative to each other, as shown in FIG. 13(*b*), and then, the two portions 27*a* and 27*b* are spot welded to each other. Therefore, it is possible to manufacture the rear supporting member 27 capable of coaxially holding the fixation roller 1 and holder 6 at a high level of accuracy, and also, holding the holder 6 at a preset angle, in terms of its circumferential direction, also at a high level of accuracy.

After each of the two pairs of supporting member portions are welded to each other, first, the fixation roller is rotatably supported by the supporting members. Then, the holder 6, which is internally holding the coil, is inserted into the hollow of the fixation roller from one of the lengthwise ends, and is rigidly attached to the supporting members. As for the attachment of the magnetic flux adjusting member 7, the magnetic flux adjusting member 7 is rigidly attached to the shutter gears accurately positioned relative to the supporting members. It is through the above described process that the holder which is internally holding the coil, add the fixation roller, are positioned relative to each other. In other words, the holder and fixation roller are attached to the same pair of supporting members. Therefore, they are more accurately positioned relative to each other, in particular, in terms of the distance between them, than they would be if they are attached in accordance with the prior art. Therefore, the fixation roller remains more stable in the amount of the magnetic flux to which it is subjected as it is rotated, being therefore higher in the level of efficiency at which heat is generated in the wall thereof.

The rear supporting member 27 is attached to the rear plate 22 of the fixing apparatus with the use of small screws put through the roughly round hole and elongated hole located at positions 27*d* and 27*e*, respectively, and the corresponding holes of the rear plate 22, making it thereby possible to prevent the holder 6 from rotating relative to the rear plate 22 of the fixing apparatus.

As described above, the fixation roller 1 as a member in which heat is generated, and the holder 6 for supporting the excitation coil assembly 3 as a magnetic flux generating means, are supported by the front and rear supporting members 26 and 27, respectively. The fixation roller 1 is rotatably supported, whereas the holder 6 is nonrotationally supported. Since the fixing apparatus is structured so that the fixation roller 1 and holder 6 are coaxially supported, the fixation roller 1 and holder 6 are improved in the level of accuracy at which they are positioned relative to each other. Therefore, the fixation roller 1 and holder 6 can be more closely positioned relative to each other than it was possible in the past, a proving therefore the efficiency with which the fixation roller 1 is heated by electromagnetic induction. Therefore, it is possible to reduce the fixing apparatus 100 in the length of time necessary for starting it up to as preset temperature level, substantially reducing thereby the fixing apparatus in energy consumption efficiency.

Further, the supporting member 26 for supporting the holder 6 (which is for holding the fixation roller 1 as a member in which heat is generated, and excitation coil assembly 3 as a magnetic flux generating member) at one of the lengthwise ends of the holder 6 is rendered independent from the supporting member 27 for supporting the holder 6 at the other lengthwise end. Therefore, not only is it possible to maintain the positional relationship between the fixation roller 1 and holder 6 at a higher level of accuracy, but also, to improve the fixing apparatus in terms of the level of ease at which the fixation roller 1, and excitation coil assembly 3 as a magnetic flux generating means 3, can be replaced.

Further, the supporting member 26 is made up of two portions: first portion 26*a* provided with a portion for supporting the fixation roller 1, and second portion 26*b* separate from the first portion 26*a* and provided with a portion for supporting the holder 6 for supporting the excitation coil assembly 3. The supporting portion 27 is also made up of two portions: first portion 27*a* provided with a portion for supporting the fixation roller 1, and second portion 27*b* separate from the first portion 27*a* and provided with a portion for supporting the holder 6 for supporting the excitation coil assembly 3. Moreover, the first and second portions 26*a* and 26*b* of the first supporting members 26 are spot welded to each other while being kept precisely positioned relative to each other with the use of the jig 61 for precisely positioning the two portions 26*a* and 26*b*, and the portions 27*a* and 27*b* of the second supporting member 27 are spot welded to each other, with the use of the jig 62 for precisely positioning the two portions 27*a* and 27*b*. Therefore, not only can the fixation roller 1 be more precisely positioned relative to the holder 6, but also, the supporting members 26 and 27 are easier to manufacture.

Because of these effects of this embodiment described above, it is possible to position the fixation roller 1 substantially closer to the holder 6 for holding the excitation coil assembly 3 as a magnetic flux generating means than in the past, making it possible to improve the fixing apparatus in terms of the level of efficiency at which heat is generated in the fixation roller 1 by electromagnetic induction. Therefore, it is possible to reduce the length of time (startup time) necessary to increase the temperature of the fixation roller 1 to a preset level suitable for image fixation, drastically improving the fixing apparatus in terms of energy consumption efficiency.

Further, the magnetic flux adjusting member 7 of a heating apparatus (fixing apparatus) can be precisely rotated into one of the preset magnetic flux adjusting positions according to recording medium size, with no chance of malfunctioning. Moreover, this embodiment was effective to improve a fixing apparatus in the length of service life, in addition to the above described improvements related to performance. Thus, this embodiment made it possible to eliminate the problem that the magnetic flux adjusting member 7 sometimes fails to be properly rotated into one of the preset positions. Therefore, it has become possible to prevent the temperature of the fixation roller 1 from unwantedly increasing across the portions corresponding to the areas outside the path of the recording medium being conveyed through the fixing apparatus.

Next, the manufacturing sequences and procedures, which are to be followed when attaching the lengthwise end portions of the fixation roller 1, heat insulating bushings 23*a* and 23*b*, bearings 24*a* and 24*b*, fixation roller driving gear G1, holder 6, magnetic flux adjusting member 7 (shutter), shutter gears G2 and G3, front supporting member 26, rear supporting member 27, of the fixing apparatus 100 to the front and rear plates 21 and 22 of the fixing apparatus 100, will be described.

Objective: to replace the fixation roller 1, which is a component to be replaced with preset intervals, and the holder 6, bearings 24*a* and 24*b*, heat insulating bushings 23*a* and 23*b*, magnetic flux adjusting member 7, gears G2 and G3, etc., which are to be replaced as they break down.

Procedure 1: remove the top unit of the fixing apparatus remove the bottom unit inclusive of the pressure roller, and the fixation roller driving unit.

Procedure 2: remove the front and rear supporting members 26 and 27—remove the fixation roller 1 (inclusive of gears G1, heat insulating bushings 23*a* and 23*b*, and bearings 24*a* and 24*b*), holder 6, shutter 7, and shutter gears G2 and G3.

Procedure 3: remove unshown gasp ring (thrust damper), and remove the gear G1, heat insulating bushings 23*a* and 23*b*, and bearings 24*a* and 24*b*, from the fixation roller 1, and replace them with new ones.

(3) Miscellanies

Figure 14:
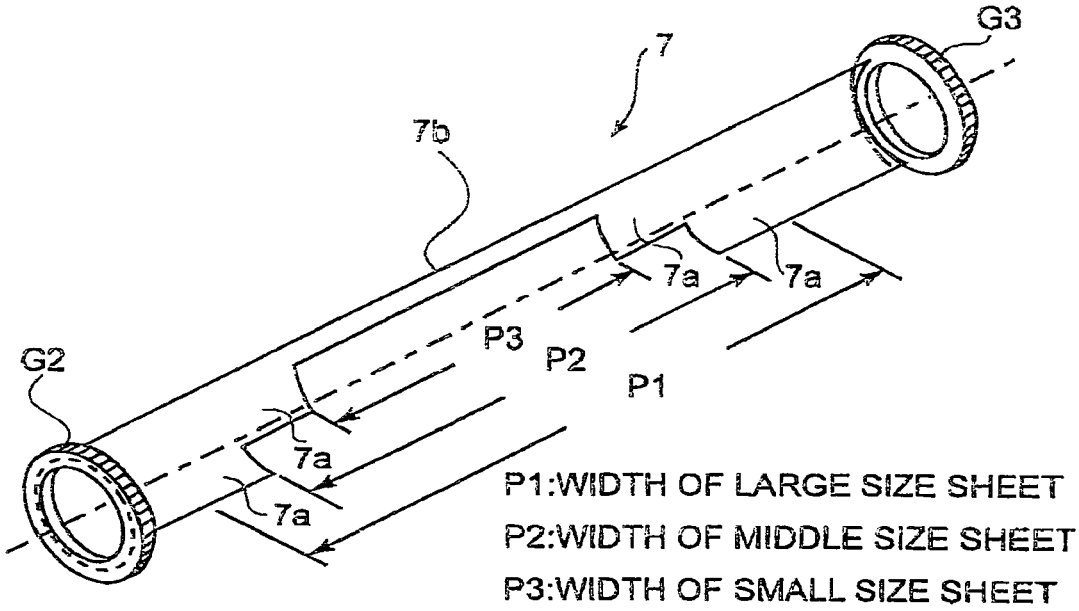
FIG. 14 is a schematic perspective view of the magnetic flux adjusting member given such a shape that enables it to accommodate three kinds of recording mediums different in width (large, medium, and small sizes).

1) The fixing apparatus in this embodiment is structured to accommodate two kinds of recording mediums different in size: recording medium of a large size and recording medium of a small size. Thus, its magnetic flux adjusting member 7 is moved into the first position or second position according to the two recording medium sizes. Obviously, a fixing apparatus may be structured so that its magnetic flux adjusting member is moved to one of three or more positions according to three or more recording medium sizes (widths). FIG. 14 is a schematic perspective view of a magnetic flux adjusting member 7 structured to accommodate three kinds of recording mediums different in width (large, medium, and small).

Figure 15:
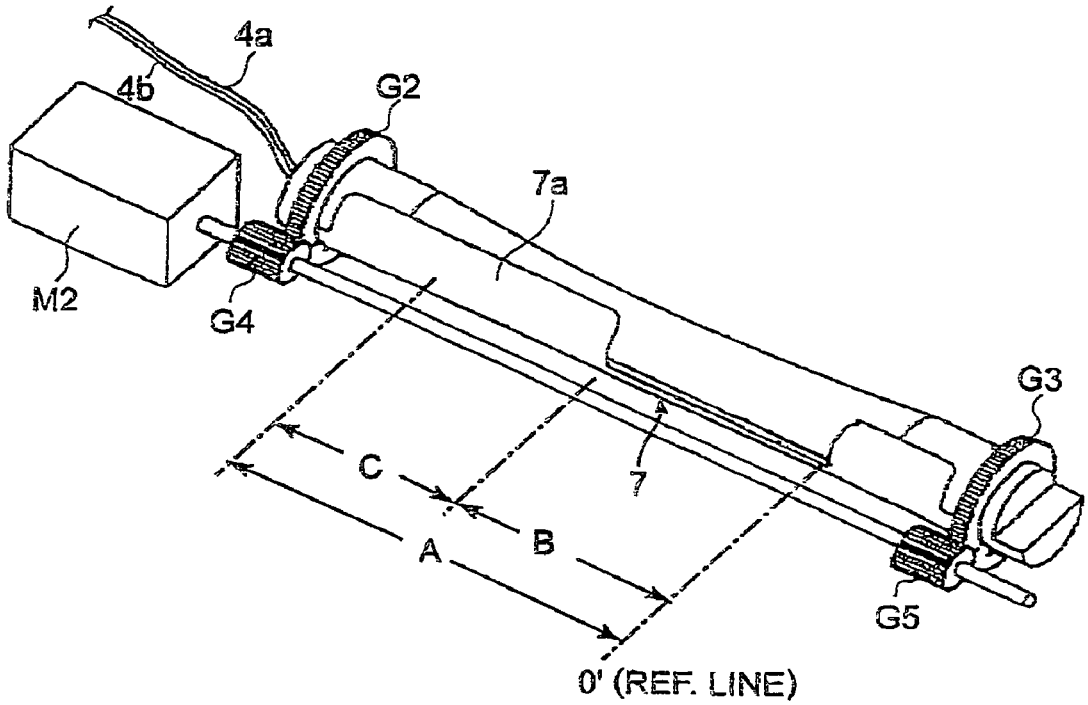
FIG. 15 is a schematic perspective view of an example of a magnetic flux adjusting member for a fixing apparatus (image forming apparatus) in which a recording medium is conveyed while one of its lateral edges is kept aligned with the positional reference with which the apparatus is provided.
Figure 16:
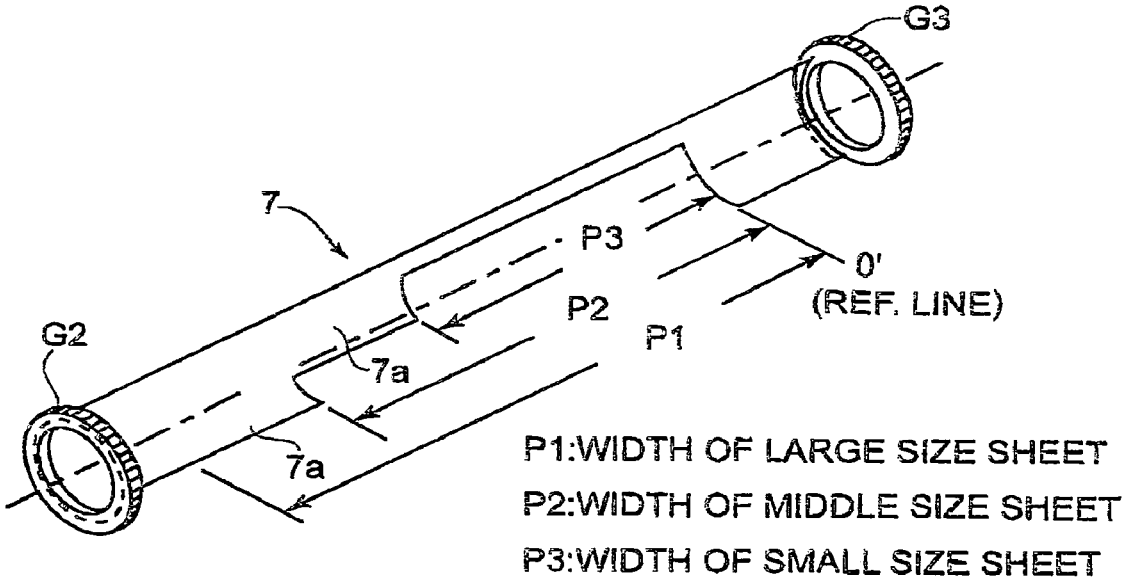
FIG. 16 is another example of a magnetic flux adjusting member for a fixing apparatus (image forcing apparatus) in which a recording medium is conveyed while one of its lateral edges is kept aligned with the positional reference with which the apparatus is provided.

2) The fixing apparatus (image forming apparatus) in this embodiment is structured to convey a recording medium in such a manner that the centerline of the recording medium, in terms of the direction perpendicular to the recording medium conveyance direction, coincides with the lengthwise center of the fixation roller. However the present invention is effectively applicable also to a fixing apparatus (image forming apparatus) structured to convey a recording medium in such a manner that one of the lateral edges of a recording medium is kept aligned with a referential line (member) with which the apparatus is provided. FIGS. 15 and 16 show the examples of the shape of the magnetic flux adjusting member for such an apparatus, that is, an apparatus in which the position of a recording medium relative to the apparatus, in terms of its width direction, is controlled with reference to only one of its lateral edges. The lines, in the two drawings, designated by a referential symbol O' are the referential lines for positioning a recording medium.

3) An image heating apparatus, to which the present invention is applicable, is not limited to the above described image heating apparatus in this embodiment. That is, the present invention is also effectively applicable to an image heating apparatus such as an image heating apparatus for temporarily fixing an unfixed image to a recording medium, and an image heating apparatus for reheating a recording medium bearing a fixed image to change the fixed image in surface properties such as glossiness. Moreover, the present invention is effectively applicable to a beating apparatus for heating an object in the form a sheet, for example, a thermal pressing apparatus for removing wrinkles from am object in the form of a sheet, a thermal laminating apparatus, a thermal drying apparatus for evaporating water content from such an object as a sheet of paper, etc., which is obvious.

According to the structural arrangements in the above described embodiment, it is possible to improve, that is, stabilize, the positional relationship between the heat roller and coil, in terms of the distance between the two, making it therefore possible to reduce the distance between the heat roller and coil to improve the fixing apparatus in the level of efficiency at which heat is generated in the heat roller. Therefore it is possible to reduce the fixing apparatus in the warmup time.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 308505/2004 filed Oct. 22, 2004 which is hereby incorporated by reference.

What is claimed is:

1. An image heating apparatus comprising:

a rotatable heating roller for heating an image on a recording material;

a coil unit disposed in said heating roller and including a coil for induction heat generation in said heating roller;

first and second bearings for rotatably supporting said heating roller at respective ends of said heating roller;

first and second supporting frames for supporting said first and second bearings, respectively;

first and second supporting members, provided in said supporting frames, respectively, for substantially non-rotatably supporting said coil unit at positions outside the respective ends of said heating roller with respect to a rotational axis direction of said heating roller.

2. An apparatus according to claim 1, wherein said coil unit has a cylindrically-shaped portion, and wherein said supporting members are fixed on said supporting frames such that said cylindrical shape portion of said coil unit and said heating roller are substantially concentric with each other.

3. An apparatus according to claim 1, further comprising a movable magnetic flux blocking member, provided between said coil unit and said heating roller, for blocking the magnetic flux directing toward said heating roller from said coil unit.

4. An apparatus according to claim 3, wherein said coil unit has a cylindrically-shaped portion, and the apparatus further comprises a gear for connecting with said magnetic flux blocking member to move said magnetic flux blocking member, and wherein said gear is mounted to said cylindrically-shaped portion, between said first supporting frame and said first supporting member.

5. An apparatus according to claim 1, wherein said first supporting member is provided with a first engaging hole engaging with said coil unit, and wherein said first engaging hole has a configuration effective to regulate rotation of said coil unit.

6. An apparatus according to claim 5, wherein said second supporting member is provided with a second engaging hole engaging with said coil unit, and wherein said second engaging hole has a circular configuration.

* * * * *